US009358440B1

(12) United States Patent
Burrell

(10) Patent No.: US 9,358,440 B1
(45) Date of Patent: Jun. 7, 2016

(54) BALL TEE

(71) Applicant: Jonathan C. Burrell, Spring Hill, KS (US)

(72) Inventor: Jonathan C. Burrell, Spring Hill, KS (US)

( * ) Notice: Subject to any disclaimer, the term of this patent is extended or adjusted under 35 U.S.C. 154(b) by 0 days.

(21) Appl. No.: 14/862,813

(22) Filed: Sep. 23, 2015

Related U.S. Application Data

(60) Provisional application No. 62/125,156, filed on Jan. 14, 2015.

(51) Int. Cl.
*A63B 69/00* (2006.01)

(52) U.S. Cl.
CPC ..... *A63B 69/0002* (2013.01); *A63B 2069/0008* (2013.01)

(58) Field of Classification Search
USPC ..... 473/417, 422, 508
See application file for complete search history.

(56) References Cited

U.S. PATENT DOCUMENTS

| | | | | |
|---|---|---|---|---|
| 5,916,045 | A * | 6/1999 | Busch | A63B 69/0075 473/417 |
| 6,358,163 | B1 | 3/2002 | Tanner | |
| 6,378,367 | B1 | 4/2002 | Dilz, Jr. | |
| 6,682,445 | B1 | 1/2004 | Tanner | |
| 7,281,998 | B2 | 10/2007 | Tanner | |
| 7,354,360 | B1 * | 4/2008 | Eckstein | A63B 69/0002 473/417 |
| 8,246,492 | B2 | 8/2012 | Gangelhoff | |
| 8,597,143 | B2 * | 12/2013 | Newman | A63B 69/0075 473/417 |
| 8,747,258 | B2 * | 6/2014 | Durham | A63B 69/0075 473/417 |
| 2008/0064534 | A1 * | 3/2008 | Lortscher | A63B 69/0002 473/417 |
| 2012/0172153 | A1 * | 7/2012 | Newman | A63B 69/0075 473/417 |

* cited by examiner

*Primary Examiner* — Nini Legesse
(74) *Attorney, Agent, or Firm* — Erise IP, P.A.

(57) ABSTRACT

The invention is directed to a ball tee for supporting a ball. The ball tee includes a base, a telescoping post, a clamp, and a ball holder. The base presents a plurality of laterally extending arms and an opening. The telescoping post includes a static segment and a first telescoping segment. The clamp is configured to secure the telescoping post to the base. The clamp is disposed at least partially within said opening of the base and at least partially around said static segment of the telescoping post. The ball holder is disposed atop the telescoping post configured to support a ball. The ball holder includes a rolled flexible sheet and an outer holder (and in some embodiments an inner holder). The rolled flexible sheet presents a generally conical shape oriented with a large end upward for supporting the ball, and is at least partially disposed within the outer holder.

6 Claims, 11 Drawing Sheets

BALL TEE

RELATED APPLICATIONS

This non-provisional patent application claims priority benefit, with regard to all common subject matter, of earlier-filed U.S. Provisional Patent Application No. 62/125,156, filed on Jan. 14, 2015, and entitled "BASEBALL BATTING TEE." The identified earlier-filed provisional patent application is hereby incorporated by reference in its entirety into the present application.

BACKGROUND

1. Field

Embodiments of the invention relate to baseball equipment. More specifically, embodiments of the invention relate to ball tees for holding a ball for a batter.

2. Related Art

Baseball players, softball players, coaches, and the like rely on ball tees to play their game and improve performance. A ball tee holds a ball stationary at a certain height such that the player may swing a bat and strike the ball. The ball tee simulates a pitched ball and provides several advantages. The ball tee allows the player to focus on the mechanics of their swing. Once the mechanics of a quality swing have been established, the player may move on to batting against pitched balls. Batting against pitched balls requires timing and reading the pitch. The use of the ball tee during batting practice therefore allows the batter to ignore these complex considerations and instead focus on swinging mechanics. In some versions of the game, common with young children, the batter will hit from the ball tee exclusively or after attempting to hit from a pitched ball (this is commonly known as T-ball). The ball tee therefore is an important equipment item for the teaching and playing of baseball.

However, ball tees of the prior art present several drawbacks. First, the ball tees provide excessive resistance to the batter, which is a poor simulation for hitting a pitched ball. Ball tees of the prior art have a tendency to grip the ball too tightly, which leads to a concussive shock through the bat and through the ball tee. Further, the bat brushes the ball holder because the barrel of the bat is larger than the ball. Second, the ball tees have a tendency to slide or tip over following a hit. The ball tee falling over requires the batter to break their stance to pick up the ball tee and slows the repetition of practice. Third, ball tees have a tendency to break and wear under the repeated pressure of being hit. Ball tee breakage is common at a ball holder (also known as the cup, where direct impacts with the bat are common), at the post which supports the ball holder, and at an intersection of a post and a base of the ball tee. Fourth, ball tees have a limited range of heights. The slides which provide friction within the telescoping posts also have a tendency to wear out.

SUMMARY

Embodiments of the invention solve the above-mentioned problems and provide a distinct advance in the art by providing an improved ball tee. The ball tee includes a ball holder formed of a rolled sheet for gently holding the ball until the hit. The ball tee also includes an improved base for reduced tipping based upon a more efficient shape and the option to add additional weight. The ball tee is also more resistant to damage due to an improved clamp for holding a post to the base and a lack of adhesives in the ball holder. Finally, the ball tee has a wide range of motion making it appropriate for batters of all sizes.

A first embodiment of the invention may provide a ball tee for supporting a ball. The ball tee includes a base, a telescoping post, a clamp, and a ball holder. The base presents a plurality of laterally extending arms and an opening. The telescoping post includes a static segment and a first telescoping segment (and in some embodiments a second telescoping segment). The clamp is configured to secure the telescoping post to the base. The clamp is disposed at least partially within said opening of the base and at least partially around said static segment of the telescoping post. The ball holder is disposed atop the telescoping post configured to support a ball. The ball holder includes a rolled flexible sheet and an outer holder. The rolled flexible sheet presents a generally conical shape oriented with a large end upward for supporting the ball, and is at least partially disposed within the outer holder.

A second embodiment of the invention may provide a ball holder configured to be utilized with a ball tee, wherein the ball tee is configured to support a ball. The ball holder includes a rolled flexible sheet and an outer holder. The rolled flexible sheet presenting a substantially conical shape including a large end and a small end. The large end of the rolled flexible sheet is configured to be oriented upward so as to support the ball. The small end is secured around a portion of a telescoping post of the ball holder.

A third embodiment of the invention may provide support for a ball tee comprising a base and a clamp. The base presents a plurality of laterally extending arms and an opening. The clamp is configured to secure a telescoping post of the ball tee to the base. The clamp is disposed at least partially within said opening of the base and at least partially around the telescoping post. The clamp includes a clamp pipe and a clamp liner. The clamp pipe presents a bifurcated upper end and a flanged lower end. The clamp liner is disposed between the clamp pipe and the telescoping post. The clamp pipe compresses the clamp liner around the telescoping post so as to secure the telescoping post therein.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
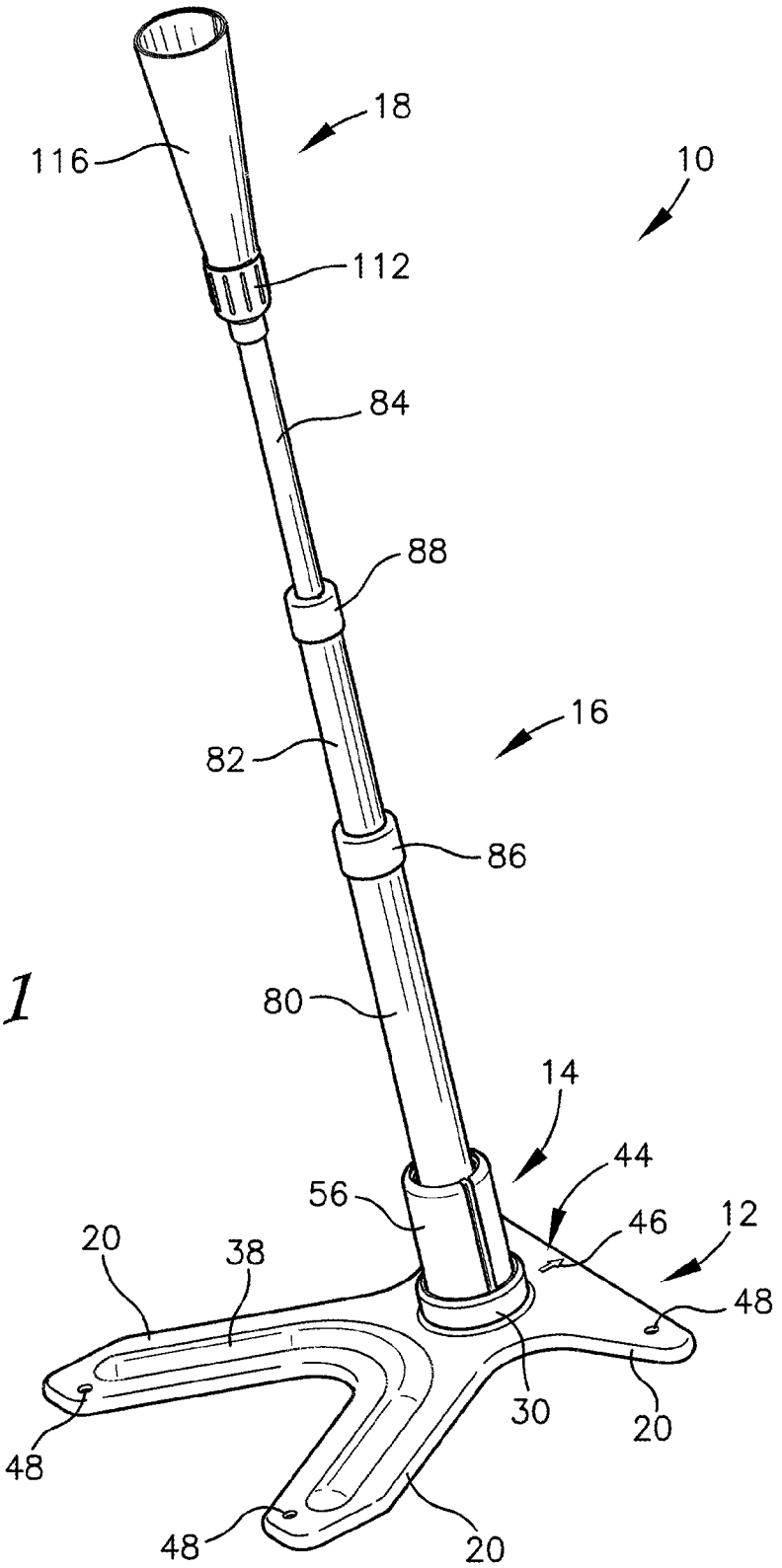
FIG. 1 is a perspective view of one embodiment of the ball tee.

The drawing figures do not limit the invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

As best illustrated in FIG. 1, a ball tee 10 of embodiments of the invention comprises a base 12, a clamp 14, a telescoping post 16, and a ball holder 18. The base 12 is secured to the telescoping post 16 via the clamp 14. The ball holder 18 is secured atop the telescoping post 16. The base 12 sits atop the ground to provide a stable base 12 for the telescoping post 16 and the ball holder 18. The telescoping post 16 adjusts up and down as desired by the batter or coach so as to simulate a pitch at various heights and/or to accommodate batters of various sizes.

Before a detailed discussion of the components of the ball tee 10, a brief discussion of a field of use of the present invention may be beneficial to the reader. The sports of baseball, softball, and the like generally involve the striking of a ball by a bat held by a batter. The batter is typically an offensive player. Following a hit, the batter will attempt to run to a base, and eventually to the home plate in order to score a run. Generally, the batter is out if, prior to reaching the base, a fielder catches the ball (prior to it striking the ground) or throws the ball to a fellow fielder that is touching the base (among other possible reasons beyond the scope of the current disclosure). Hitting the ball too high is called a fly ball and is typically easy for the fielder to catch. Hitting the ball too low is called a grounder and is typically easy for the fielder to recover and throw to a fellow fielder. A well-hit ball is typically called a line drive and is high enough to clear infield fielders, yet not too high such that it is easy to catch by outfield fielders. The line drive is achieved by a powerful, well-timed, and squarely contacted hit.

Accordingly, an important aspect of these sports is squarely hitting the ball with as much power as can be mustered by the batter. Squarely hitting the ball is based upon reading a pitch correctly (i.e. determining where it will cross in front of the batter) and timing the swing correctly (based upon reading the pitch correctly and executing the swing at the right time). The power of the batter is based chiefly upon the technique used by the batter, e.g. how efficiently and smoothly batter swings, how much body weight and muscle power is used, etc. Further, the goal is to generate very high exit speed of the ball leaving the bat. Ball exit speed can be measured by radar. Ball exit speed is directly correlated to bat swing speed. So, the higher the bat speed, the higher the ball exit speed, and the more likely the hit ball will result in the batter reaching base. Embodiments of the invention are useful in teaching proper swinging technique to a batter. The ball tee 10 is a tool used by a coach or fellow player to allow the batter to practice their swing technique. The ball tee 10 also allows the coach of fellow player to closely watch the batter to determine issues with the batter's swing technique.

Typically, the ball tee 10 is used in the following manner. The base 12 of the ball tee 10 is emplaced in the desired location (such as near home plate on a field, in a batting cage, etc). In some instances, the ball tee 10 is used in conjunction with an actual or simulated (e.g. painted on the floor) home plate, such that the batter can simulate pitches near them (a.k.a inside pitches) and away from them (a.k.a outside pitches). The telescoping post 16 is then adjusted to the desired height for the batter. It should be appreciated that batters are required to hit balls at different heights based upon the pitch. Accordingly, the batter's swinging technique will change slightly based upon the height and location of the pitch. Many batters have difficulty hitting a certain type of pitch (such as a low and inside pitch). The ball tee 10 therefore accommodates allowing the batter to practice hitting such as pitch. After the height and location of the ball tee 10 are adjusted as desired, a baseball, a softball, or the like (generically, a "ball") is placed thereon either by the batter, the fellow player, or the coach.

The batter then swings at the bat at the ball in one continuous motion. An ideal swing will contact the ball perpendicular to an imaginary line from the ball tee 10 to a pitcher's mound (the "forward direction"), and slightly elevated upward so as to maximize the distance of the hit. It is desirable that the ball tee 10 not fully tip over following the hit. Another ball is then placed atop the ball tee 10 and the process repeated.

It should be appreciated that the fields of baseball and softball are only an exemplary field of use. Other fields of use for the invention include other sports. One embodiment of the invention is directed to an improved golf tee. For example, the golf tee may generally resemble the ball tee 10 described herein with a relatively larger ball holder 18 and a relatively shorter telescoping post 16 (or a static post). One embodiment of the invention is directed to an American Football kicking stand (also known as a kicking holder and/or a kicking tee). Other embodiments of the invention are directed to supporting equipment for other sports. Other fields of use for the invention include other supporting devices. These could include support stands for photography cameras, video cameras, microphones, music, industrial equipment, and the like.

The components of the ball tee 10 will now be discussed in greater detail. As discussed above, the ball tee 10 broadly comprises the base 12, the clamp 14, the telescoping post 16, and the ball holder 18. The base includes a plurality of laterally extending arms 20. The clamp 14 securely holds the telescoping post 16 to the base 12. The telescoping post 16 is inserted into a portion of the base 12, typically from the top. The clamp 14 is then inserted into the the base 12, typically from the bottom, such that the clamp 14 surrounds a portion of the telescoping post 16. As the clamp 14 is driven into the opening of the base 12 and around the telescoping post 16, the clamp 14 grips the telescoping post 16 so as to provide a stable support for the ball tee 10. In some embodiments, the base 12 and the clamp 14 are referred to collectively as the "support" of the ball tee 10.

Figure 5:
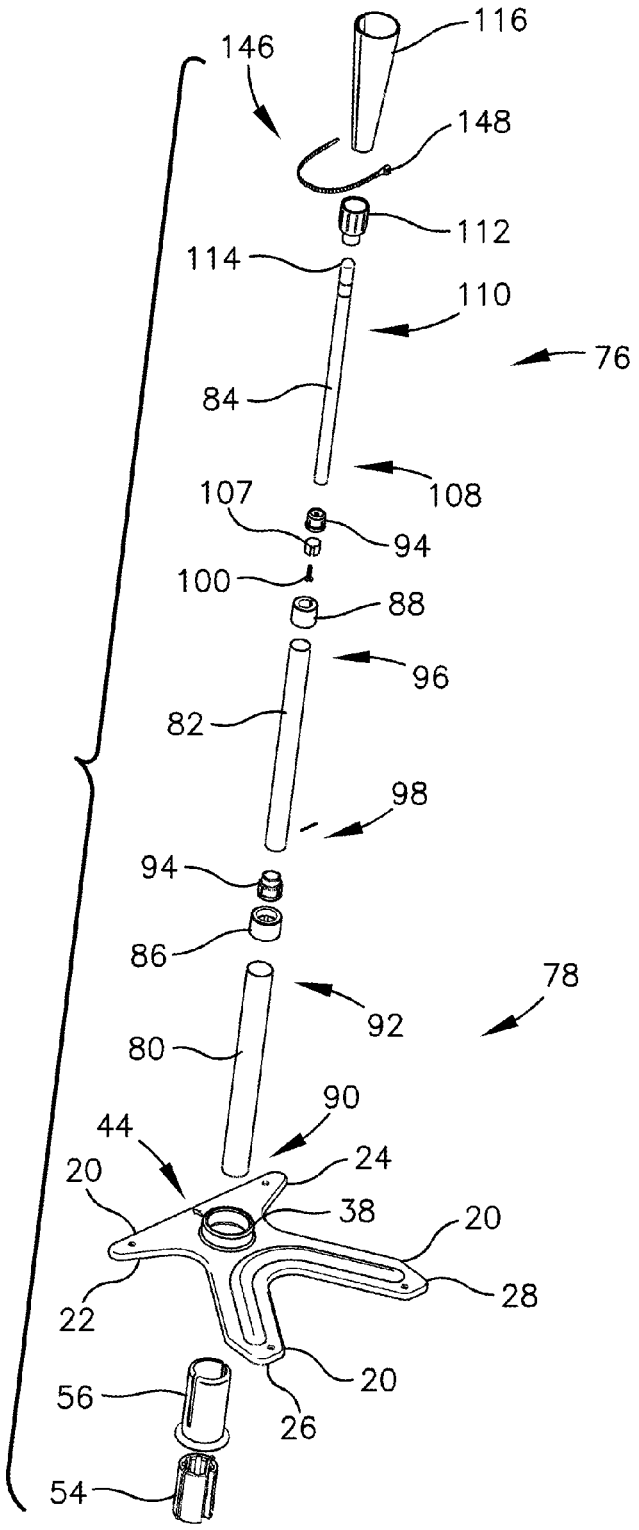
FIG. 5 is an exploded view illustrating the various components of the ball tee from FIG. 1.
Figure 6:
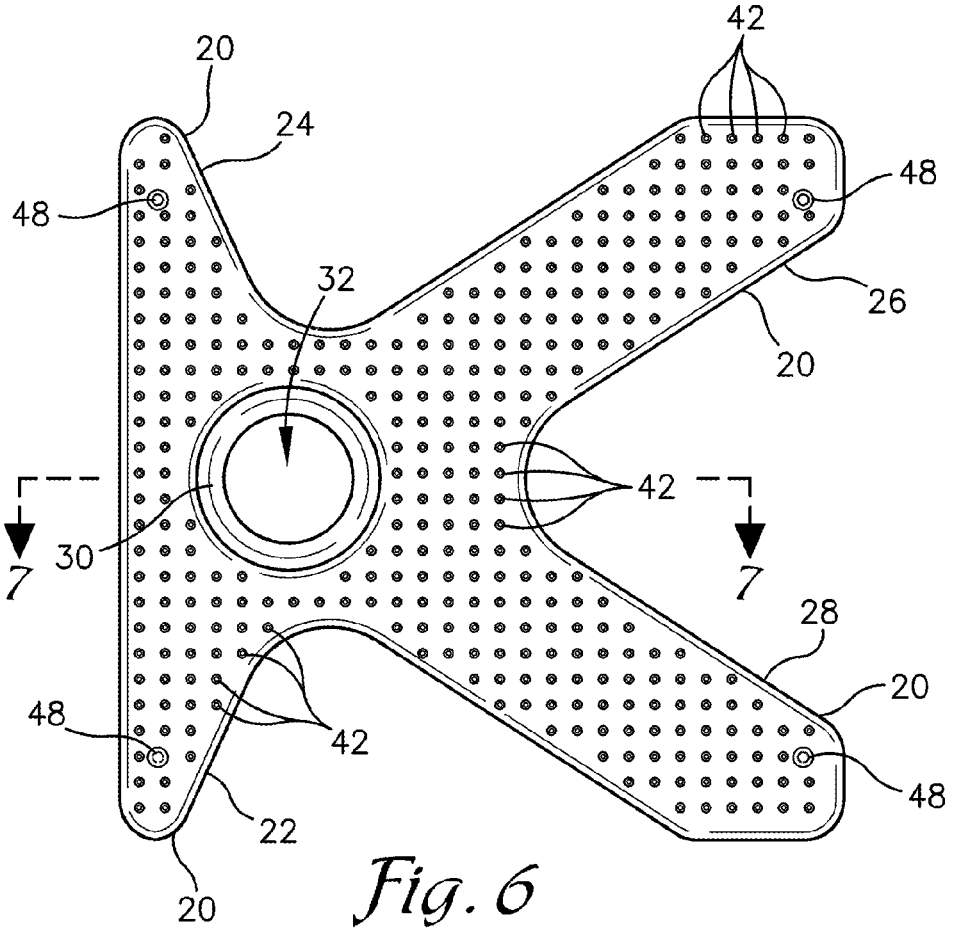
FIG. 6 is a bottom view of the base of the ball tee, illustrating a general K-shape configuration of laterally extending arms.

As best illustrated in FIGS. 1 and 5, in embodiments of the invention, the base 12 of the ball tee 10 is generally K-shaped when viewed from above. The base 12 of these embodiments includes a first-base-side lateral arm 22, a third-base-side lateral arm 24, a first-base-line arm 26, and a third-base-line arm 28. It should be appreciated that the first base line is generally diagonally forward and right, and that the third base line is generally diagonally forward and left on a standard baseball diamond. As discussed below, in embodiments of the invention, the base 12 of the ball tee 10 presents another shape when viewed from above. The first-base-line arm 26 and the third-base-line arm 28 prevent tipping when the ball tee 10 is struck by the bat. The first-base-line arm 26 and the third-base-line arm 28 move the fulcrum forward, such that a majority of the weight of the ball tee 10 fall behind the fulcrum. This reduces the likelihood of tipping compared to symmetrical ball tees (which are common in the prior art).

The first-base-side lateral arm 22 and the third-base-side lateral arm 24 provide stability for the rebounding action and the shaking caused by the bat striking the ball tee 10. In embodiments of the invention, the first-base-side lateral arm 22 and the third-base-side lateral arm 24 are shorter than the first-base-line arm 26 and the third-base-line arm 28. The first-base-side lateral arm 22 extends substantially perpendicular to a line between a pitcher and a catcher, extending generally toward a first base side. The third-base-side lateral arm 24 extends substantially perpendicular to said line between the pitcher and the catcher, extending generally toward a third base side.

As best illustrated in FIG. 5, in embodiments of the invention, the base 12 of the ball tee 10 further includes a raised ring 30 that presents an opening 32. The opening 32 is configured to receive the telescoping post 16 and the clamp 14 therethrough, as discussed below. The raised ring 30 provides structural support for the opening 32 so as to prevent or minimize the tipping of the telescoping post 16 relative to the base 12. In embodiments of the invention, the raised ring 30 presents a circular shape about a horizontal cross-section or as viewed from above. In other embodiments, the raised ring 30 presents another shape about a horizontal cross-section, such as an ellipse, a triangle, a square, etc. Similarly, in embodiments of the invention, the opening 32 of the raised ring 30 presents a circular shape about a horizontal cross-section. In other embodiments, the opening 32 presents another shape about a horizontal cross-section, such as an ellipse, a triangle, a square, etc. In some embodiments, the shape presented by the raised ring 30 is different than the shape presented by the opening 32.

Figure 4:
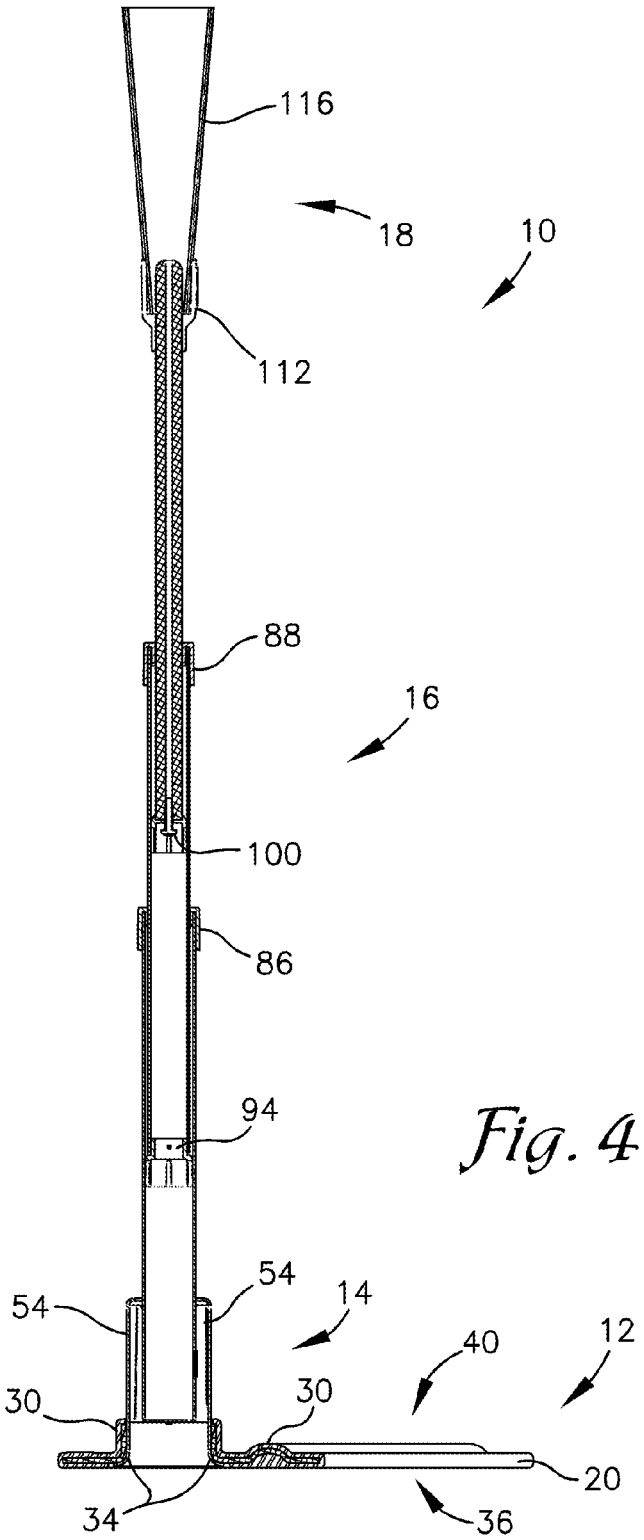
FIG. 4 is a vertical cross-sectional view of the ball tee of FIG. 1, generally from a first base side, as taken through the 4-4 line in FIG. 3.
Figure 7:
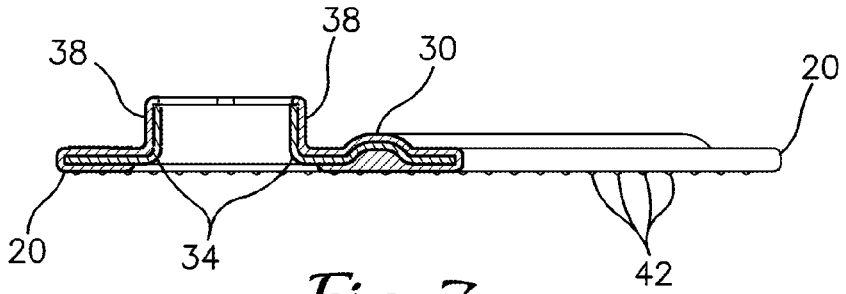
FIG. 7 is a vertical cross-section view of the ball tee, as taken through the 4-4 line of FIG. 3.

As best illustrated in FIGS. 4 and 7, in embodiments of the invention the raised ring 30 presents a beveled bottom 34. The beveled bottom 34 presents a complementary shape to a portion of the clamp 14 (as discussed below). This allows the flange of the clamp 14 to sit off of or adjacent to the ground when the base 12 is sitting on the ground.

The base 12 of the ball tee 10 further includes a generally flat bottom side 36 and a reinforcing ridge 38 on a top side 40 of the base 12. The bottom side 36 interfaces with the ground and may include a plurality of protrusions 42. The plurality of protrusions 42 increases the surface area in contact with the ground and increases the friction between the base 12 and the ground. This prevents (or reduces) the ball tee 10 from sliding forward upon being struck by the bat.

The reinforcing ridge 38 is formed in the base 12 and provides additional structural stiffness and stability for the base 12. The reinforcing ridge 38 prevents a deflection or bending of the first-base-line arm 26 and the third-base-line arm 28. The reinforcing ridge 38 may be formed of a bending, stamping, or other deformation of the base 12.

As best illustrated in FIGS. 1 and 5, the base 12 may further include an orientation indicator 44, such as the word "catcher" with an arrow 46, to indicate the preferred orientation of the ball tee 10. This is because in embodiments such as the base 12 having the general K-shape, the ball tee 10 prevents tipping the best when the ball tee 10 is oriented correctly (i.e. with the first-base-line arm 26 and the third-base-line arm 28 aligned with the actual or theoretical base lines). The orientation indicator 44 may be a raised portion of the base 12 so as to prevent wearing.

In embodiments of the invention, the base 12 includes a plurality of fastener openings 48. These fastener openings 48 are disposed on the laterally extending arms 20 of the base 12. An operator may secured fasteners through the fastener openings 48 to secure the ball tee 10 to a floor or ground. For example, in a batting practice area, the ball tee 10 may be semi-permanently secured to the ground to prevent tipping. In some embodiments, the fastener openings 48 are also provided so that a steel stiffener can be centrally held for the purpose of rubber over-mold tooling.

Figure 2:
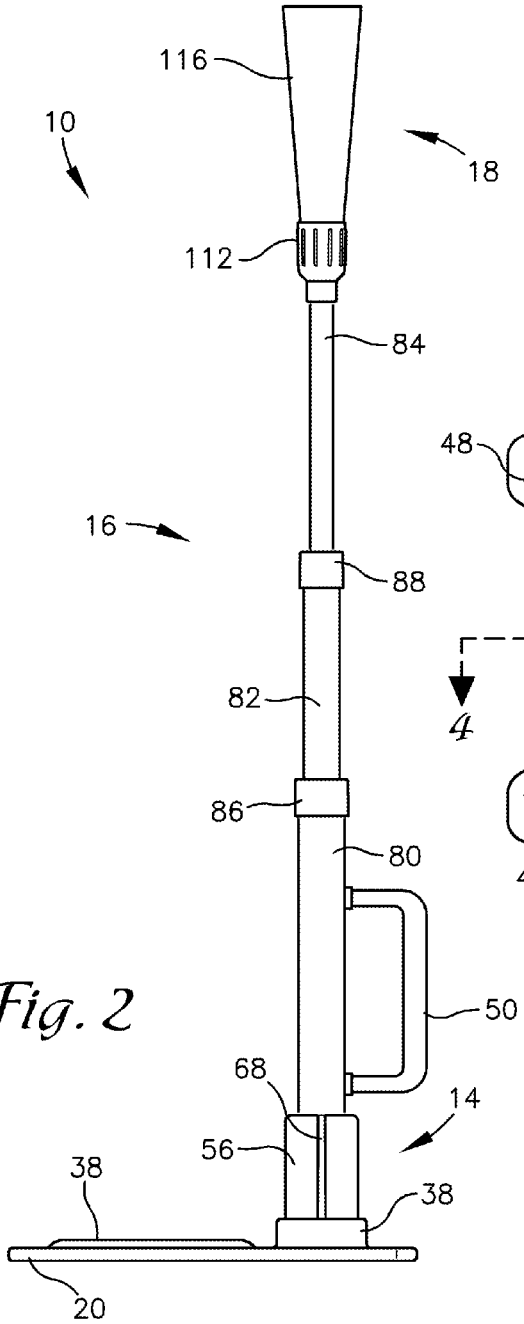
FIG. 2 is a side view of the embodiment of the ball tee from FIG. 1, generally from a third base side.

As illustrated in only FIG. 2, in embodiments of the invention, the base 12 includes a handle 50 to facilitate the carrying of the ball tee 10 by the user. The handle 50 may be oriented backward so as to prevent tipping. In other embodiments, the handle 50 is disposed on the telescoping post 16 to prevent the ball tee 10 from fully tipping to the ground. For example, the handle 50 may be disposed on the telescoping post 16 and oriented vertically. Upon a strong hit to the ball tee 10 by a bat, the ball holder 18 and telescoping post 16 will tip slightly forward, though a full tipping over will be prevented by the first-base-line arm 26 and the third-base-line arm 28. The ball holder 18 and telescoping post 16 may then tip backwards on recoil. The full tipping backwards is prevented by the handle 50, such that the ball tee 10 may be oriented at an angle, with the ball tee 10 being supported by the handle 50, the first-base-side lateral arm 22, and the third-base-side lateral arm 24. In other embodiments, such as the X-shaped base 12 discussed below, the backward-facing (i.e. toward the catcher) arms prevent the backward tipping.

In embodiments of the invention, the base 12 is formed of a polymer, such as EPDM, neoprene, or natural rubber. In other embodiments of the invention, the base 12 is formed of a metal, such as a sheet metal. In still other embodiments, the base 12 is formed of a metal and then covered with a layer of polymeric material. Metal provides structural stability benefits. Polymers provide elastomeric properties and also an increased friction between the base 12 and the ground. The polymer therefore provides a tough but soft outer skin for the base 12.

Figure 8:
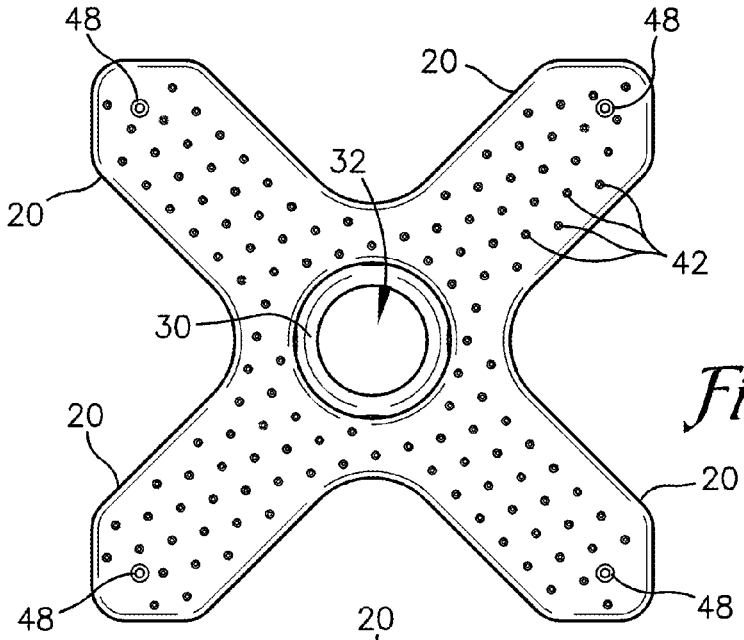
FIG. 8 is a bottom view of the base of the ball tee, illustrating a general X-shape configuration of the laterally extending arms.
Figure 9:
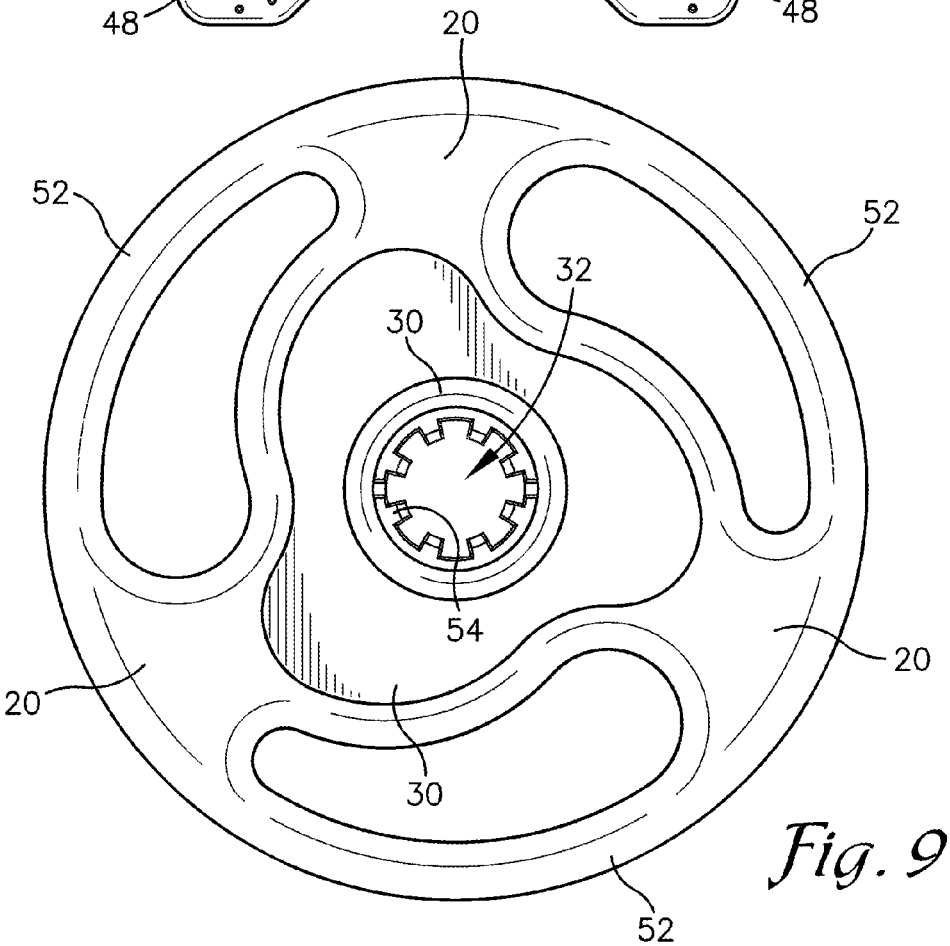
FIG. 9 is a bottom view of the base of the ball tee, illustrating a generally circular shape of the laterally extending arms.

As illustrated in FIGS. 8 and 9, the base 12 may present another shape as viewed from above. The base 12 may present an X-shape and presents four laterally extending arms 20. In one embodiment, each of the four laterally extending arms 20 is approximately the same length and each is separated from its neighbor by approximately ninety degrees. In other embodiments, each arm is approximately the same length, a first arm and a second arm are separated by an acute angle, and a third arm and a fourth arm are separated by an acute angle. By correlation, the second arm and the third arm are separated by an obtuse angle, and the fourth arm and the first arm are separated by an obtuse angle. In some embodiments, the four laterally extending arms 20 present different lengths and widths (relative to each other) so as to maximize tipping prevention for the material used. The X-shaped base 12 may also include the orientation indicator 44 as discussed above.

As illustrated in FIG. 9, the base 12 may present a circular shape. In these embodiments, the base includes laterally extending arms 20 and an outer ring 52 surrounding the laterally extending arms 20. In still other embodiments, the base presents another shape such as an ellipse, a triangle, a rectangle, a V-shape, a U-shape, an A-shape, or a T-shape. In each of these embodiments, the plurality of laterally extending arms 20 form the discussed shape so as to maximize the tipping prevention for the amount of material used.

The clamp 14 secures the base 12 to the telescoping post 16. The clamp 14 is inserted into the opening 32 of the base 12, typically from the bottom so as to securely grip the telescoping post 16, as illustrated in FIG. 5. The clamp 14 includes a clamp liner 54 and a clamp pipe 56. In embodiments of the invention, the clamp liner 54 and the clamp pipe 56 are separate and distinct components that work in concert to perform the clamping function. The clamp liner 54 is disposed around and adjacent to the telescoping post 16. The clamp pipe 56 is disposed around the clamp liner 54 and adjacent to the raised ring 30 of the base 12. For clarity, in the assembled ball tee 10 from the interior to the exterior the components are as follows: the telescoping post 16, the clamp liner 54, the clamp pipe 56, the raised ring 30 of the base 12, and the base 12.

Figure 10:
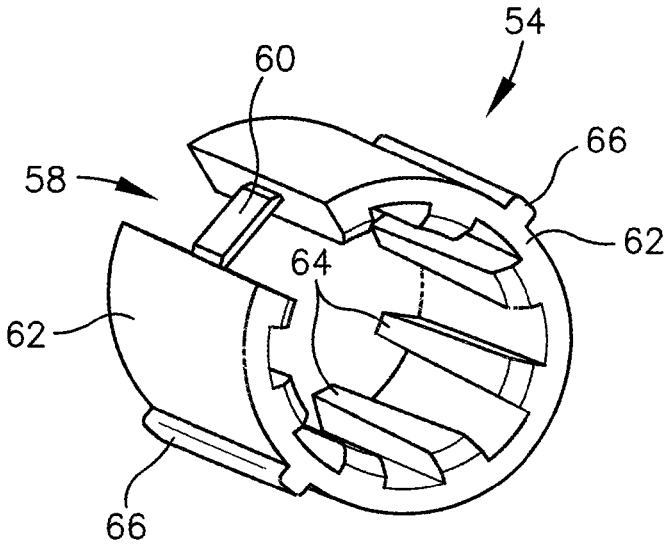
FIG. 10 is a perspective view of a clamp liner of a clamp of the ball tee.

The clamp liner 54, as illustrated in FIG. 10, presents a generally cylindrical shape with a gap 58 therein. When viewed from above, the clamp liner 54 presents a general C-shape. In embodiments of the invention, a knockout tab 60 is disposed in the gap 58 upon original manufacture. The knockout tab 60 is then removed before the ball tee 10 is assembled. The gap 58 provides space from the clamp liner 54 to contract around the telescoping post 16. As the clamp pipe 56 is inserted around the clamp liner 54 and the telescoping post 16, the gap 58 is reduced or eliminated.

In embodiments of the invention, the clamp liner 54 includes an encasing wall 62 and a plurality of interior ridges 64. The encasing wall 62 presents the general C-shape discussed above and generally surrounds the telescoping post 16. The interior ridges 64 are secured to the encasing wall 62 and generally directed inward therefrom. The interior ridges 64 directly contact the telescoping post 16 and are configured to compress to keep the telescoping post 16 secure. In some embodiments of the invention, the clamp liner 54 further includes a plurality of exterior ridges 66. The exterior ridges 66 are secured to the encasing wall 62 and generally directed outward. The exterior ridges 66 align with a corresponding plurality of slits 68 in the clamp pipe 56 (as discussed below). In an embodiment as illustrated in FIG. 10, eight interior ridges 64 and two exterior ridges 66 are utilized in the clamp liner 54. In embodiments of the invention, the clamp liner 54 is formed of a polymer such as a plastic. In some embodiments, a frictional sheet (not illustrated) is further used between clamp liner 54 and the telescoping post 16 to increase the friction therebetween.

Figure 3:
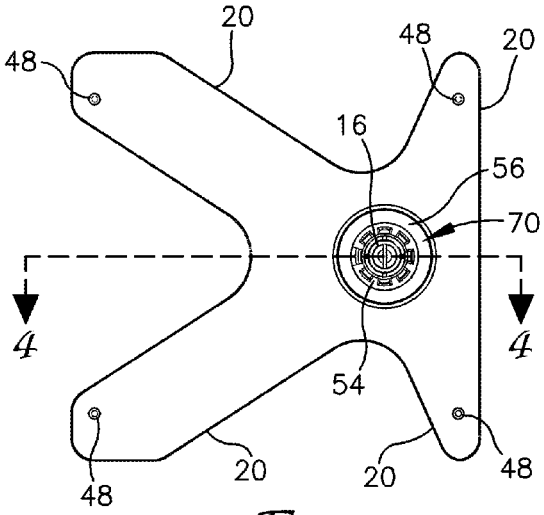
FIG. 3 is a bottom view of the ball tee from FIG. 1, generally showing a base of the ball tee.
Figure 11:
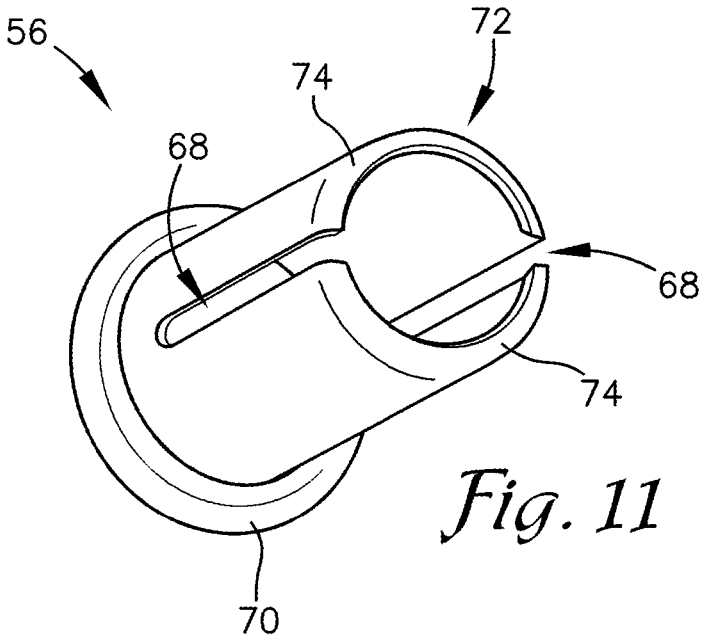
FIG. 11 is a perspective view of a clamp pipe of the clamp of the ball tee.

The clamp pipe 56, as illustrated in FIG. 11, is generally cylindrical. The clamp pipe 56 includes a flanged lower end 70, a bifurcated upper end 72, and at least one slit 68. The clamp pipe 56 is generally inserted into the bottom of the ball tee 10, as illustrated in FIGS. 3 and 5. The at least one slit 68 separates two arcuate plates 74 at the bifurcated upper end 72. The slit 68 aligns with at least one exterior ridge 66 of the clamp liner 54. The slit 68 and the exterior ridge 66 therefore present complementary shapes. The slit 68 and the exterior ridge 66 keep the clamp liner 54 and the clamp pipe 56 properly aligned. The slit 68 allows the clamp pipe 56 deflect inward or outward slightly. The inward deflection allows the clamp pipe 56 to securely hold the clamp liner 54.

It should be appreciated that, as used herein, "bifurcated" can include more than two arcuate plates 74 (i.e. trifurcated, quadfurcated, etc.). For example, in one embodiment, there are three slits 68 in the bifurcated upper end 72 of the clamp pipe 56 and three arcuate plates 74. Additional arcuate plates 74 for the clamp pipe 56 result in each arcuate plate 74 being narrower. This allows for greater deflection but also reduces the holding strength.

The flanged lower end 70 of the clamp pipe 56 provides structural support for the clamp pipe 56 as well as a convenient structure for pressing the clamp pipe 56 into the ball tee 10. The clamp pipe 56 is driven into the ball tee 10 by various methods, such as manually, via the striking of a blunt object (such as a hammer), via a mechanical press, or the like. The flanged lower end 70 is adapted to bear the force of the insertion and provide a generally flat bottom that aligns with the base 12. If the clamp pipe 56 is not fully driven in, the ball tee 10 may not sit flat on the ground. The flanged lower end 70 therefore presents a complementary shape to the beveled bottom 34 of the raised ring 30 of the base 12.

In embodiments of the invention, the clamp liner 54 is installed into the clamp pipe 56 by manually squeezing closed the C-shaped encasing wall 62 (i.e. reducing the gap 58) and inserting the clamp liner 54 from the flanged lower end 70 of the clamp pipe 56. Typically, the clamp liner 54 will snap into place such that the exterior ridges 66 of the clamp liner 54 enter the slits 68 of the clamp pipe 56. Then the combined clamp liner 54 and the clamp pipe 56 (which may be referred to collectively as the "clamp") are inserted into the opening 32 in the base 12 from the bottom side 36. The clamp 14 snaps into place as a portion of the clamp passes through the raised ring 30 of the base 12. It should be noted that in embodiments of the invention, the exterior ridges 66 of the clamp liner 54 protrude slightly beyond an outer diameter the pipe clamp 56, which allows the clamp 14 to snap into place beyond the raised ring 30. In some embodiments of the invention, the clamp 14 is further secured to the base 12 via a chemical adhesive, welding, or the like.

In embodiments of the invention, the clamp pipe 56 is formed of metal, such as steel, and the clamp liner 54 is formed of a polymer, such as a polycarbonate. The clamp liner 54 therefore deflects based upon the clamp pipe 56 being driven therearound. Further, the clamp liner 54 prevents the telescoping post 16 from being damaged by the clamp pipe 56.

In embodiments of the invention, the clamp pipe 56 and the clamp liner 54 present a generally circular shape about a horizontal cross-section or as viewed from above, as illustrated in FIGS. 10 and 11. As discussed above, in other embodiments of the invention, the raised ring 30 presents the opening 32 with another shape such as an ellipse, a triangle, a square, etc. The clamp pipe 56 and clamp liner 54 of these embodiments present a similar and generally complementary shape to the opening 32.

The telescoping post 16 raises the ball to the desired height. As best illustrated in FIGS. 2 and 4-5, the telescoping post 16 provides support for the ball holder 18 at a distal end 76 and is secured to the base 12 at a proximal end 78. The telescoping post 16 can be adjusted longer or shorter by the user as desired. In embodiments of the invention the telescoping post 16 comprises a static segment 80, a first telescoping segment 82, a second telescoping segment 84, a lower telescope bushing 86, and an upper telescope bushing 88. Generally, the static segment 80 is disposed at the proximal end 78, the first telescoping segment 82 is disposed between the proximal end 78 and the distal end 76 of the telescoping post 16, and the second telescoping segment 84 is disposed at the distal end 76 of the telescoping post 16. The ball tee 10 has a range of available heights based upon the position of the telescoping post 16. In embodiments of the invention, this range is substantially from 22 inches to 45 inches. In embodiments of the invention, the minimum available height is approximately 18 to 26 inches, approximately 20 to 24 inches or approximately 22 inches. In embodiments of the invention, the maximum available height is approximately 40 to 50 inches, approximately 43 to 47 inches, or approximately 45 inches.

The first telescoping segment 82 is disposed at least partially within the static segment 80, as best illustrated in FIG. 4. The lower telescope bushing 86 is disposed between the static segment 80 and the first telescoping segment 82 to secure the first telescoping segment 82 in a certain position relative to the static segment 80. The second telescoping segment 84 is disposed at least partially within the first telescoping segment 82. The upper telescope bushing 88 is disposed between the first telescoping segment 82 and the second telescoping segment 84 to secure the second telescoping segment 84 in a certain position relative to the first telescoping segment 82. Accordingly, an outer diameter of the first telescoping segment 82 is substantially the same as or slightly smaller than an inner diameter of the static segment 80, and an outer diameter of the second telescoping segment 84 is substantially the same as or slightly smaller than an inner diameter of the first telescoping segment 82.

The static segment 80 is secured to the base 12 at a lower end 90 via the clamp 14, as discussed above. The lower telescope bushing 86 is secured at an upper end 92 of the static segment 80. The lower telescope bushing 86 is configured to selectively engage and disengage from the first telescoping segment 82 that is disposed therein. In embodiments of the invention, the lower telescope bushing 86 is engaged and disengaged by a user by rotating a portion of the lower telescope bushing 86 around the static segment 80.

The lower telescope bushing 86 is secured around the static segment 80 to guide the first telescoping segment 82 secured in a certain position. The first telescoping segment 82 is disposed between the static segment 80 and the second telescoping segment 84, as best illustrated in FIGS. 4-5. In embodiments of the invention, the first telescoping segment 82 includes a slide assist 94. The upper telescope bushing 88 is secured to an upper end 96 of the first telescoping segment 82 and the slide assist 94 is secured to a lower end 98 of the first telescoping segment 82.

Figure 12:
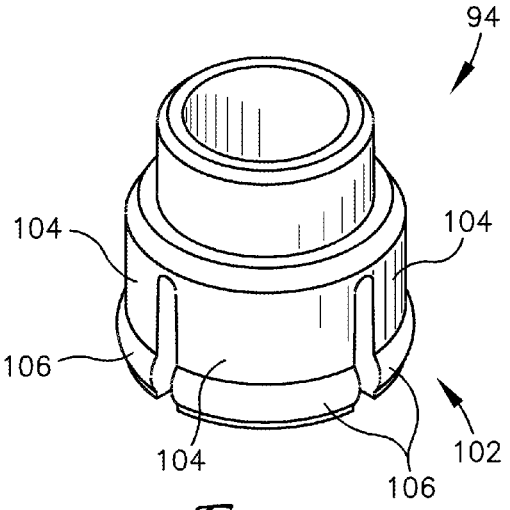
FIG. 12 is a perspective view of a slide assist of the telescoping post of the ball tee.

In embodiments of the invention, the slide assist 94 is secured to the first telescoping segment 82 (or the second telescoping segment 84) via a frictional hold, via an adhesive, and/or via a fastener 100. In other embodiments, the slide assist 94 is a monolithic component of the first telescoping segment 82. The slide assist 94 presents an outer diameter that is slightly larger than the outer diameter of the first telescoping segment 82. Similarly to the clamp pipe 56 discussed above, the slide assist 94 presents a bifurcated end 102 (as illustrated, with four arcuate plates 104) and an engaging ridge 106 thereon, as illustrated in FIG. 12. The engaging ridge 106 is configured to contact an inner surface of the static segment 80 or first telescoping segment 82.

In embodiments of the invention, the slide assist 94 includes an actuator 107 for providing a radially extending force to increase the friction between the slide assist 94 and the segment in which it is disposed. The actuator 107 may be a C-shaped spring formed of steel (commonly known as a roll pin) or a helical wire spring (not illustrated). In embodiments of the invention, the slide assist 94 is formed of polycarbonate or nylon.

The upper telescope bushing 88 is secured around the first telescoping segment 82 to allow the second telescoping segment 84 to smoothly move relatively to the first telescoping segment 82. The upper telescope bushing 88 allows the second telescoping segment 84 to slide relative to the first telescoping segment 82 such that the telescoping post 16 becomes longer and shorter (and the ball holder 18 becomes higher and upper).

In embodiments of the invention, the telescoping post 16 remains in that given position based upon friction at the upper telescope bushing 88, lower telescope bushing 86, and/or the slide assist 94. In some embodiments of the invention, the upper telescope bushing 88 and the lower telescope bushing 86 further include a locking function. In these embodiments, the upper telescope bushing is changed between positions via a rotation of the telescope bushing 86, 88 about the respective segment 80, 82 of the telescoping post 16, the pressing of a button, the release of a lever, or the manipulation of a clamp etc.

In embodiments of the invention, the upper telescope bushing 88 and/or the lower telescope bushing 86 may include knobs thereon to provide a rubberized grip. These knobs may be emplaced over the plastic bushings 86, 88. In some embodiments a color or colors presented by the knobs are customizable to make different color accents for different teams or people. This allows the user or owner to identify their specific ball tee 10 and show team spirit.

The second telescoping segment 84 is disposed at least partially within the first telescoping segment 82 and secured in place by the upper telescope bushing 88. The second telescoping segment 84 is disposed at a lower end 108 within the first telescoping segment 82. The second telescoping segment 84 at an upper end 110 interfaces with the ball holder. In some embodiments, such as illustrated in FIG. 4, the upper end 110 of the second telescoping segment 84 functions as the inner holder of the ball holder (discussed below). In embodiments of the invention, unlike the static segment 80 and the first telescoping segment 82 that have a relatively thin wall, the wall of the second telescoping segment 84 is relatively thick. This is because the second telescoping segment 84 is prone to increased damage due to being struck by an errant bat and because there is nothing disposed within the second telescoping segment 84 (save a fastener as discussed below).

The slide assist 94 of the second telescoping segment 84 may include a fastener 100 to secure the slide assist 94 thereto. This is because in embodiments of the invention it is desirable that the second telescoping segment 84 has a high impact resistance possible and the slide assist 94 has a high wear resistance. Therefore the fastener 100 is used to secure the two different materials together. It should also be noted that in embodiments of the invention, the second telescoping segment 84 is hollow because that shape lends itself to manufacture by an extrusion process. In other embodiments of the invention, the slide assist 94 is molded into and/or is monolithic with the second telescoping segment 84.

In embodiments of the invention, the entire telescoping post 16 is formed of a polymer. For example, the telescoping post 16 may be formed of a polycarbonate by plastic extrusion process. As another example, the telescoping post 16 may be formed by injection molding of a plastic. In other embodiments, the telescoping post 16 is formed of a metal, such as stainless steel. In some embodiments, the static segment 80, the first telescoping segment 82, and the second telescoping segment 84 are each formed of either stainless steel or a polymer, and more than one type of material is used in the telescoping post 16. For example, the static segment 80 and the first telescoping segment 82 may be formed of metal, and the second telescoping segment 84 is formed of a polymer. In one embodiment, the second telescoping segment 84 is formed of a polycarbonate, which has a high impact strength so as to withstand incidental contact with the bat.

In some embodiments of the invention, the ball tee 10 includes a forward-facing radar (not illustrated) with a real-time readout display. This is because, as discussed above, generating a high exit speed of the ball leaving the bat is a key to successful swings. Ball exit speed is measured by the radar. Batted ball exit speed is directly correlated to bat swing speed. The radar therefore gives an indication of bat swing speed based upon the ball exit speed. This can be instrumental in improving bat swing speed. In embodiments of the invention, the radar is configured to be disposed on the base 12 or the static segment 80 of the telescoping post 16. In other embodiments, the radar is selectively secured to the static segment 80 by the user, such as via a clip. In still other embodiments, the radar is configured to be selectively secured to the base 12, such as at an intersection of the first-base-line arm 26 and the third-base-line arm 28. In still other embodiments, the radar is configured to be placed on the ground. Typically, the antenna of the radar is oriented forward so as to track the ball exit speed. In some embodiments, the radar may additionally measure bat swing speed, ball spin, calculated hit distance, calculated maximum height of the hit, exit angle of the ball, etc. The real-time readout display may be configurable to face toward a right-handed batter and toward a left-handed batter.

In some embodiments of the invention, the telescoping post 16 comprises the static segment 80 and the first telescoping segment 82 (i.e. without the second telescoping segment 84). In other embodiments, the telescoping post 16 comprises the static segment 80 (i.e. without either telescoping segment). In still other embodiments, the telescoping post 16 comprises the static segment 80, the first telescoping segment 82, the second telescoping segment 84, and a third telescoping segment (not illustrated), such that the ball holder is secured to the third telescoping segment.

In some embodiments, the higher segments of the telescoping post 16 present a larger diameter than the lower segments. As such, the lower segments are disposed at least partially within the higher segments. For example, the static segment 80 is disposed at least partially within the first telescoping segment 82, the lower telescope bushing 86 is secured to the first telescoping segment 82, the first telescoping segment 82 is disposed at least partially within the second telescoping segment 84, and the upper telescope bushing 88 is secured to the second telescoping segment 84.

Figure 16:
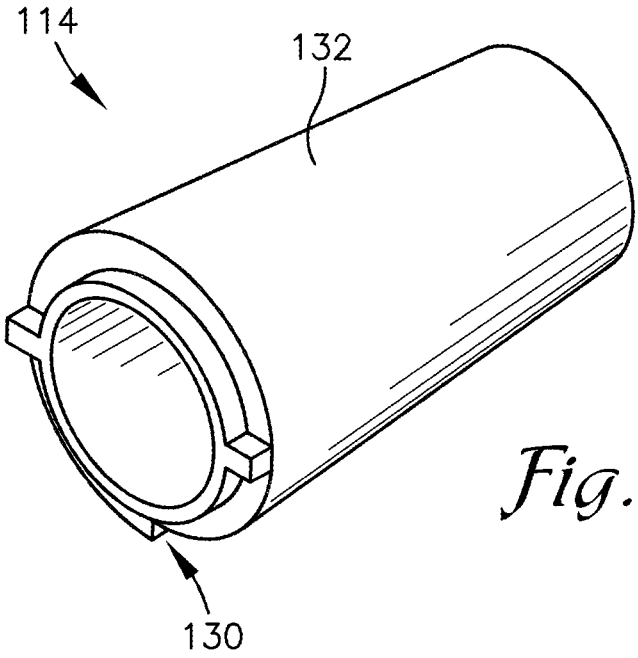
FIG. 16 is a perspective view of an inner holder of the ball tee, generally from a top side.
Figure 17:
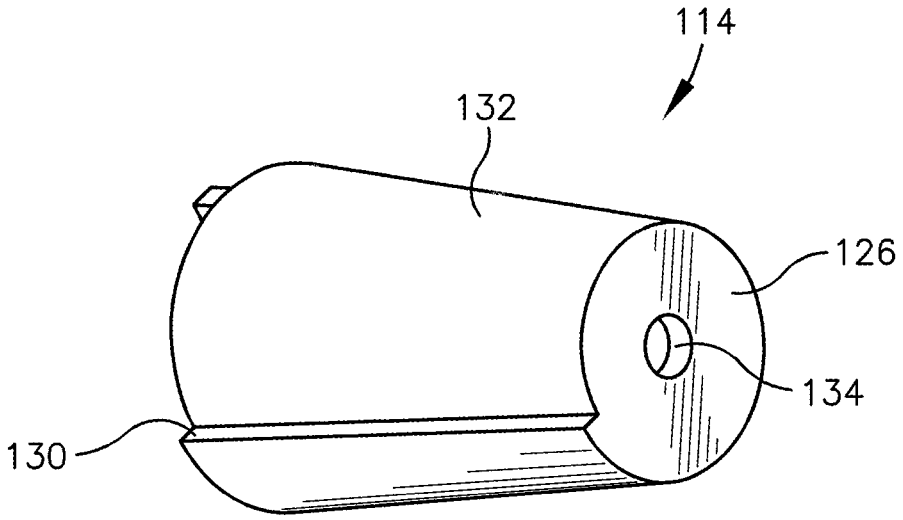
FIG. 17 is another perspective view of the inner holder of the ball tee, generally from a bottom side.

The ball holder 18 provides a stable platform for the ball, from which a bat of the batter may strike off the ball smoothly and cleanly. In embodiments of the invention, the ball holder 18 broadly comprises an outer holder 112, an inner holder 114, and a rolled flexible sheet 116. The rolled flexible sheet 116 is disposed around the inner holder 114. The inner holder 114 is surrounded by the rolled flexible sheet 116 and the outer holder 112. It should be appreciated that in some embodiments the inner holder 114 is a portion of the second telescoping segment 84 (i.e. the rolled flexible sheet 116 is secured around the upper end 110 of the second telescoping segment 84), and in other embodiments the inner holder 114 is a separate and distinct component such as illustrated in FIGS. 16 and 17. In the assembled ball holder 18, the rolled flexible sheet 116 is disposed partially around the inner holder 114 and partially within the outer holder 112.

Figure 13:
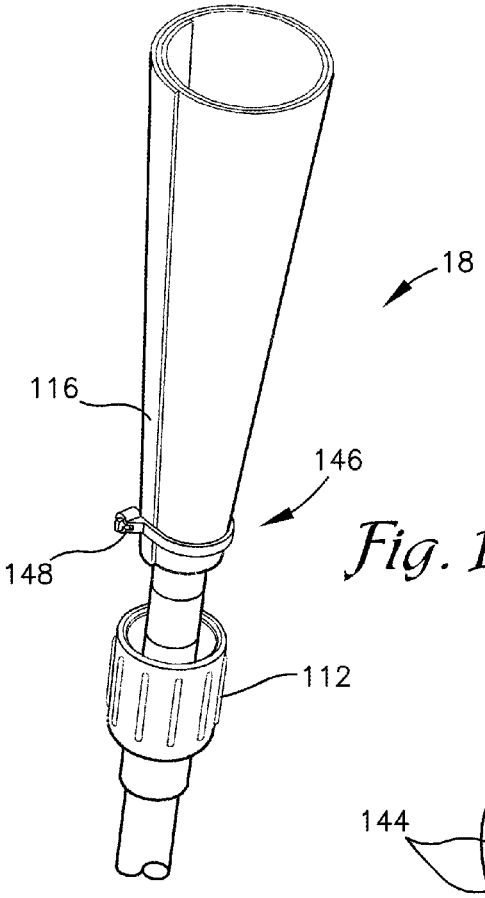
FIG. 13 is a perspective view of an embodiment of the ball holder of the ball tee.

The rolled flexible sheet 116 is substantially conical shape, as best illustrated in FIGS. 1 and 13. The conical shape of the rolled flexible sheet 116 includes a large end and a small end. The large end is open (i.e. presents a void upon which the ball is placed). The large end of the rolled flexible sheet 116 is configured to be oriented upward so as to support the ball. The ball is placed partially atop the rolled flexible sheet 116. The small end is secured by and mated with the inner holder 114 and the outer holder 112. The inner holder 114 and the outer holder 112 ensure secured and durable hold on the rolled flexible sheet 116, such that the ball may be supported.

In embodiments of the invention, the large end of the rolled flexible sheet 116 presents a beveled top edge that is substantially complementary to a shape presented by the ball. The beveled top edge of the large end of the rolled flexible sheet 116 is formed by cutting the large end at an angle prior to rolling the rolled flexible sheet 116. The beveled top edge allows the ball to securely sit atop the ball holder 18 and to be smoothly hit therefrom. The beveled top edge is less likely to bind to the ball upon a hit and less likely to induce topspin.

Figure 14:
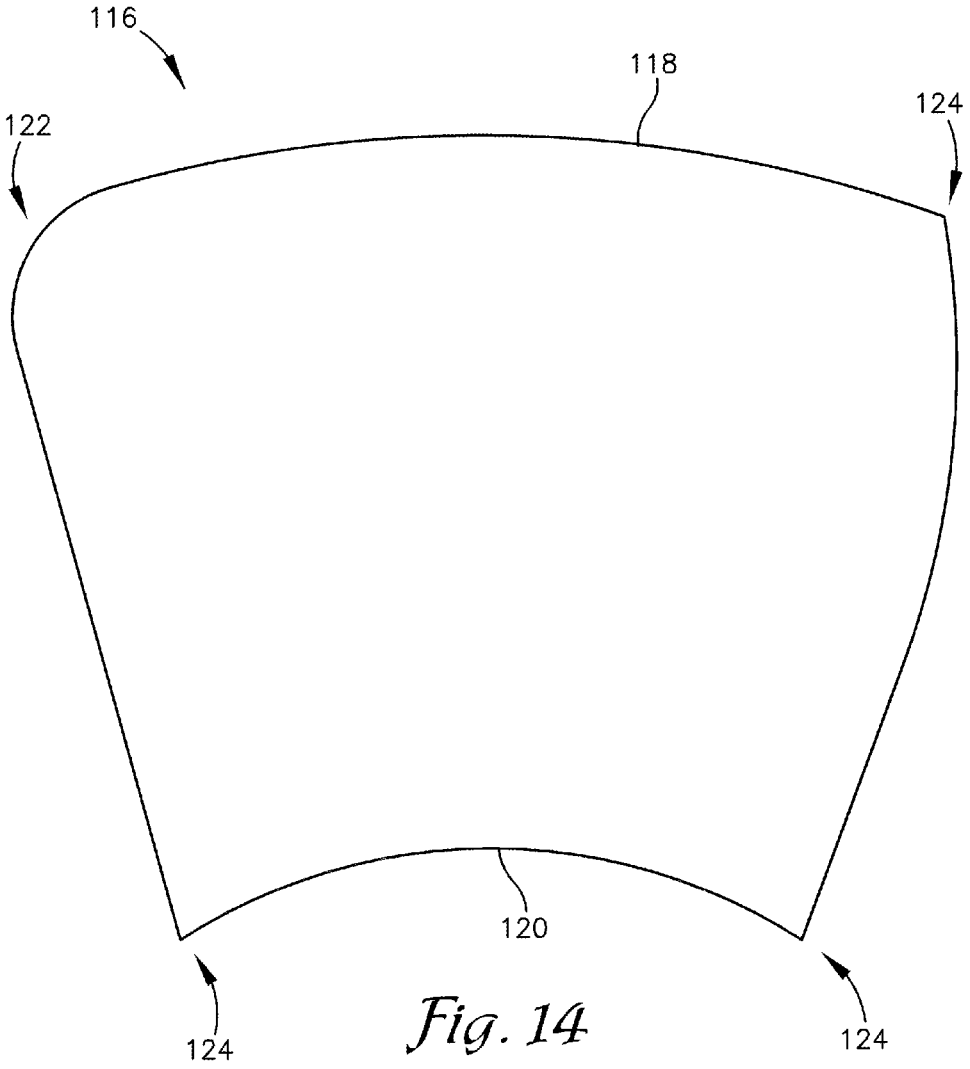
FIG. 14 is an exemplary top view of a flat flexible sheet that will be rolled to form a rolled flexible sheet for supporting the ball.

An example of a flat flexible sheet 116 (i.e. the rolled flexible sheet 116 that is not in a rolled configuration) is illustrated in FIG. 14. The flat flexible sheet 116 is formed of a flat sheet of material (as discussed below). In embodiments of the invention, the flat flexible sheet 116 includes a convex upper end 118 and a concave lower end 120. The convex upper end 118 provides, when rolled into the conical shape, a substantially flat shape along the top edge. The concave lower end 120 provides, when rolled into the conical shape, a substantially flat shape along the lower end. The concave lower end 120 also presents a complementary shape to a portion of the inner holder 114 and/or outer holder 112. In embodiments of the invention, the flat flexible sheet 116 also includes arcuate corners 122 and angled corners 124. The arcuate corners 122 prevent damage to the rolled flexible sheet 116 caused by something catching an angled corner 124. The angled corners 124 provide a concrete complementary shape to which the inner holder 114 is mated. In embodiments of the invention, the rolled flexible sheet 116 is formed of a polymer, such as neoprene.

In embodiments of the invention, the inner holder 114 is disposed within a portion of the conical shape of the rolled flexible sheet 116. In some embodiments of the invention, as illustrated in FIG. 4, the inner holder 114 is the upper end 110 of the second telescoping segment 84. In other embodiments, as illustrated in FIGS. 16 and 17, the inner holder 114 is a separate element that presents a complementary shape to the interior of the conical shape of the rolled flexible sheet 116. The inner holder 114 of these embodiments includes a bottom segment 126, a top segment 128, a mating wall 130, and a rounded wall 132. The bottom segment 126 includes a fastener receptor 134 (as discussed below).

Figure 18:
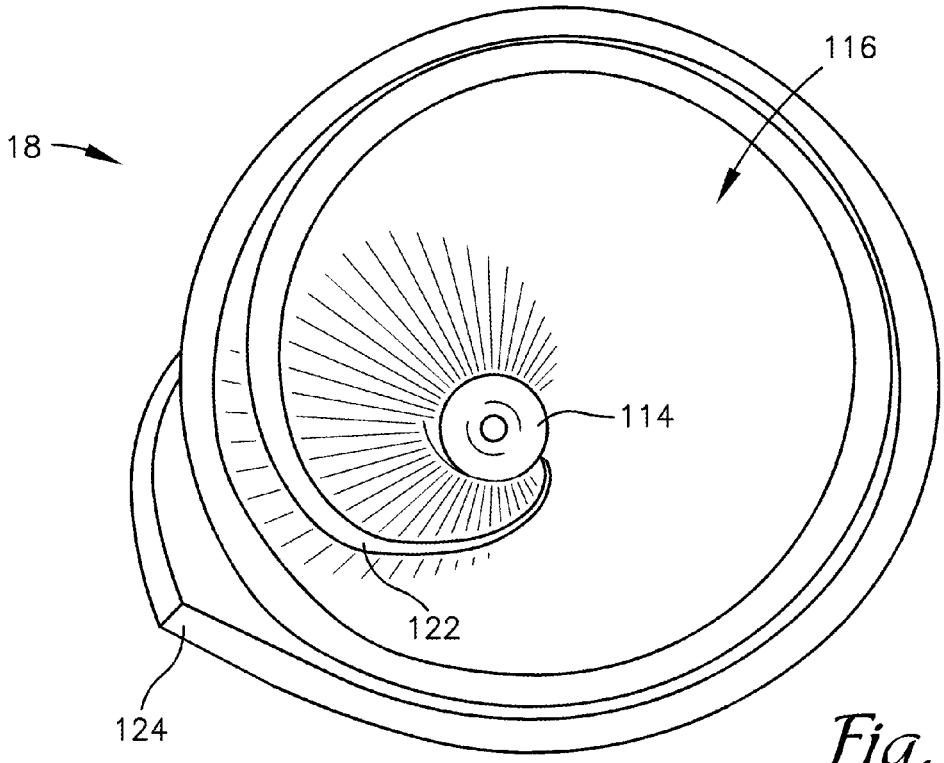
FIG. 18 is a top view of the rolled flexible sheet, illustrating a beveled top edge.

The flat flexible sheet 116 is rolled around the inner segment by placing a side of the flat flexible sheet 116 against the upper end 110 of the second telescoping segment 84 or the mating wall 130 of the inner holder 114. The flat flexible sheet 116 is then snuggly rolled around the inner holder 114. It should be appreciated that in the assembled ball tee 10, such as illustrated in FIG. 1, the inner holder 114 is not visible, with the possible exception of the top segment 128 of the inner holder 114 when viewed from above (as illustrated in FIG. 18). It should also be appreciated that in some embodiments of the invention, the ball holder 18 comprises the rolled flexible sheet 116 and the outer holder 112, without the use of an inner holder 114.

Figure 15:
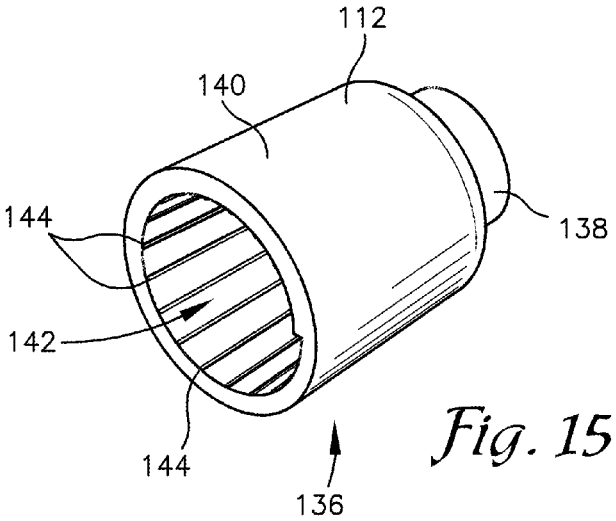
FIG. 15 is a perspective view of an outer holder of the ball holder.

The outer holder 112, as illustrated in FIG. 15, is disposed around the small end of the rolled flexible sheet 116. The outer holder 112 secures the rolled flexible sheet 116 in place so as to prevent the rolled flexible sheet 116 from becoming unrolled. The outer holder 112 includes a sheet interface 136 and a post interface 138. The sheet interface 136 includes a conical section 140 that presents a void 142. In embodiments of the invention, the conical section 140 presents interior ridges 144 for providing a frictional hold of the rolled flexible sheet 116. The void 142 presents a complementary shape to the shape presented by the rolled flexible sheet 116 and/or the inner holder 114.

In embodiments of the invention, the post interface 138 of the outer holder 112 is configured to fit around and over the second telescoping segment 84. The post interface 138 is generally tubular and monolithic with (or secured to) the sheet interface 136. The post interface 138 may be secured to the second telescoping segment 84 via a frictional hold, a mechanical fastener, and/or a chemical adhesive. In embodiments of the invention in which a friction hold is utilized, the ball holder 18 is easily removable by the user and may dislocate instead of break upon a particularly hard hit on the ball holder 18. In embodiments of the invention, the outer holder 112 is formed of a polymer, such as neoprene rubber.

In embodiments of the invention, the outer holder 112 is secured to the inner holder 114 via a fastener (not illustrated). In this way, the ball holder 18 does not utilize any chemical adhesives. Instead, the ball holder 18 is secured using a mechanical compression. The fastener secures the inner holder 114 tight against the outer holder 112. As the lower end of the rolled flexible sheet 116 is secured therebetween, the rolled flexible sheet 116 is securely held. Also, the flexible sheet 116 may be selectively uninstalled by the removal of the fastener. This may be advantageous for transportation of the ball tee 10 in which the rolled flexible sheet 116 may be prone to damage. This may also be advantageous for repairing or replacing the rolled flexible sheet 116 and preventing water damage.

In embodiments of the invention, the rolled flexible sheet 116 is secured into its conical shape around the second telescoping segment 84 and held in that shape via the use of a mechanical restraint 146, as illustrated in FIG. 13. The mechanical restraint 146 has a certain allowable diameter and will thus prevent the conical shape of the rolled flexible sheet 116 from exceeding this allowable diameter. The mechanical restraint 146 may also be covered by the outer holder 112. The mechanical restraint 146, in one embodiment, is a standard zip tie 148. The standard zip tie 148 is secured around the rolled flexible sheet 116 to secure it in place. In other embodiments, the rolled flexible sheet 116 is secured into the conical shape with the use of a chemical adhesive.

In one embodiment of the invention, the flexible sheet 116 is rolled directly onto the second telescoping segment 84 and retained in this position with two zip ties 148 (as illustrated in FIG. 13). The outer holder 112 is then slipped over the zip ties from below. In this embodiment, no tape or adhesive is necessary to keep the ball holder 18 in its shape. Further, a pneumatic zip tie tool (not illustrated) that tensions the zip tie 148 and snips excessive material off may be utilized to install zip ties as discussed above.

Figure 19:
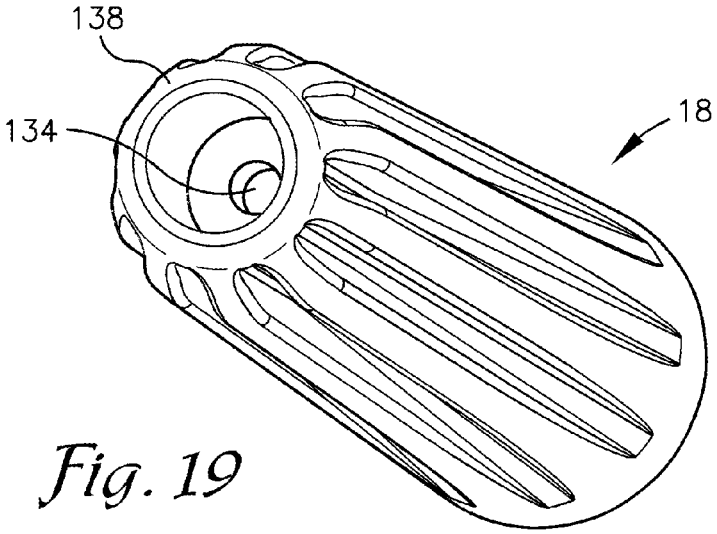
FIG. 19 is a perspective view of an alternative embodiment of a monolithic ball holder.

In other embodiments, such as illustrated in FIG. 19, the ball holder 18 is monolithic. In these embodiments, the ball holder therefore does not include a rolled flexible sheet 116.

In embodiments of the invention, the ball tee 10 is configured to receive additional weights thereon. The addition of weights further prevents tipping. The addition of weights by the user (as opposed to a permanent weight secured to the ball tee 10) allows the user to customize the weight used based upon the application. Larger weights may be used for adult batters and smaller weights may be used for children batters. Further, such as in a game of tee ball, the weight may not be important because rapid repetition of hitting is not utilized.

In embodiments of the invention, the diameter of the ball holder 18 and the diameter of the clamp 14 are both two inches or less. Two inches is the standard opening diameter in a common Olympic flat weight. This allows the user to utilize weights that are already owned or easily obtained. The user places the weight over the ball holder 18 and slides the weight down around the telescoping post 16 and the clamp 14 until the weight rests on the base 12. In other embodiments, the ball holder 18 presents a diameter of more than two inches and the ball holder 18 is easily removed via a frictional hold. This allows greater ball-surface contact while still permitting the use of standard flat weights. In other embodiments, weights are used that are specifically designed to be added to the ball tee 10.

Further, in embodiments in which the clamp 14 is substantially two inches in diameter, the user may selectively add a standard lockjaw collar to provide an additional clamping force. The standard lockjaw collar is commonly used in weightlifting to secure the weights to the bar. In this instance, such a lockjaw collar can be selectively utilized if additional clamping force is necessary for securely holding the telescoping post 16 to the base 12.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A support for a ball tee comprising:

a base presenting a plurality of laterally extending arms and an opening;

a clamp configured to secure a telescoping post of the ball tee to the base, said clamp disposed at least partially within said opening of the base and at least partially around the telescoping post, wherein the clamp includes— a clamp pipe presenting a bifurcated upper end and a flanged lower end; and a clamp liner disposed between the clamp pipe and the telescoping post, wherein the clamp pipe compresses the clamp liner around the telescoping post so as to secure the telescoping post therein.

2. The support of claim 1, wherein the clamp pipe is configured to be inserted through the opening of the base from a bottom side such that the clamp liner is secured within the clamp pipe.

3. The support of claim 1, wherein the laterally extending arms of the base form a general K-shape when viewed from above.

4. The support of claim 1, wherein the base includes a reinforcing ridge that protrudes vertically along at least one of said laterally extending arms to prevent or reduce deflection of said laterally extending arm.

5. The support of claim 1, wherein the base includes a raised ring, such that the opening in the base is presented within the raised ring.

6. The support of claim 1, wherein the clamp liner presents a general C-shape when viewed from above, such that the clamp liner presents a gap, wherein the gap is reduced during installation of the clamp liner within the clamp pipe.

* * * * *